US005518248A

United States Patent [19]

Lightfoot

[11] Patent Number: 5,518,248

[45] Date of Patent: May 21, 1996

[54] GOLF BOARD GAME

[76] Inventor: Ben H. Lightfoot, 13515 Krestwood Dr., Burnsville, Minn. 55337

[21] Appl. No.: 41,941

[22] Filed: Apr. 2, 1993

[51] Int. Cl.[6] ..... A63F 3/00

[52] U.S. Cl. ..... 273/245; 273/298

[58] Field of Search ..... 273/242, 243, 273/245, 259, 298, 244

[56] References Cited

U.S. PATENT DOCUMENTS

| | | | |
|---|---|---|---|
| 1,520,081 | 12/1924 | Purnell | 273/245 |
| 1,535,126 | 4/1925 | McNair et al. | 273/245 |
| 1,541,202 | 6/1925 | Winbigler | 273/245 |
| 2,618,482 | 11/1952 | Grogan | 273/245 |
| 3,355,175 | 11/1967 | Carroll et al. | 273/245 |
| 3,819,185 | 6/1974 | Lowther | 273/245 |
| 4,134,590 | 1/1979 | Conrad | 273/245 |
| 4,364,569 | 12/1982 | Duwell et al. | 273/245 |
| 4,380,338 | 4/1983 | Lacy | 273/245 |
| 4,809,985 | 3/1987 | Trimble | 273/245 |
| 5,000,460 | 3/1991 | Barbiaux et al. | 273/245 |

FOREIGN PATENT DOCUMENTS

| | | | |
|---|---|---|---|
| 2198651 | 6/1988 | United Kingdom | 273/245 |
| 2220147 | 1/1990 | United Kingdom | 273/245 |

*Primary Examiner*—William E. Stoll

[57] ABSTRACT

A sports board game to simulate golf and method of playing are provided. The game comprises a master set of outcomes divided into subsets, each subset representing a particular shot. Each subset has a plurality of outcomes and the game provides means for selecting one of the plurality of outcomes. The method of playing involves repeated selection of outcomes until a completed outcome is obtained.

3 Claims, 1 Drawing Sheet

GOLF BOARD GAME

TECHNICAL FIELD

The present invention pertains to a game in the nature of a board game or a parlor game which simulates a golf game.

BACKGROUND ART

The game of golf has long been a popular game with many people. However, previously there has been no enjoyable simulation of the game of golf in the form of a board game or parlor game. Hereinafter, the term board game will be used in the patent specification and claims to refer collectively to board games and parlor games. The simulation of various sports games as board games has been achieved in the past. Furthermore, many, if not all sports games, including golf, have been simulated for play on electronic video games. However, all of these simulations have been unavailing in the field of simulating the game of golf. No game has been designed which accommodates the entertainment value of golf into a format which is playable by persons of all ages and can incorporate many of the additional features of golf such as the many betting modes available to golf players.

DISCLOSURE OF INVENTION

The present invention is a game in the nature of a board game which simulates in an entertaining way the game of golf. The central features of this game are the division of a golf hole into a series of areas, each area requiring a certain golf shot to advance the ball and the use of a master set of outcomes for the golf shots. This master set of outcomes is divided into a number of subsets. Each of the subsets represents one different particular golf shot, e.g., tee shot, pitching, or putting. Thus, the subsets directly relate to the areas on the hole.

In a preferred embodiment, the master set of outcomes is generally divided into eight subsets. Each of these subsets corresponds to a particular shot. Furthermore, it is preferred that, for at least some of the subsets there are sub-subsets depending on the length, that is the par, of the hole. The preferred master set used for the game of the present invention has the following subsets: (1) tee shot, (2) long iron/wood, (3) mid iron, (4) short iron, (5) pitching, (6) chipping, (7) in trap, and (8) putting.

Any of the subsets can be further divided into sub-subsets to more accurately depict the various shots. In a preferred embodiment of the master set, four of the subsets have sub-subsets:

(1) tee shot with sub-subsets (a) par 3, (b) par 4, and (c) par 5;

(2) long iron/wood with sub-sets: (a) par 4 and (b) par 5;

(3) in trap with sub-sets; (a) fairway par 4, (b) fairway par 5 and (c) greenside trap; and (4) putting with sub-subsets (a) long putt and (b) short putt.

In the preferred embodiment, no par three sub-subset is provided for the long iron/wood subset because in that embodiment the plurality of outcomes for a tee shot on a par three hole are all good enough to not require a long iron/wood shot. Further, in the preferred embodiment, the mid iron, short iron, pitching, and chipping subsets do not have sub-subsets. However, any, all or none of the subsets may have sub-subsets.

Within each subset or sub-subset, there are a plurality of different outcomes. These outcomes range from the need to take another shot of the same or a different type, to being an indication that the next shot is a "gimmee" (that is, a concession that one more shot will put the ball in the hole) to an indication to "score it" that is, the shot put the ball in the hole.

Means are provided for determining which particular outcome out of the plurality of possible outcomes for any subset is applicable to any turn. Many different means of selection among the plurality of outcomes are possible. Preferably, the selection is random with the random selection means being for example, cards, dice, a wheel, a computer-controlled random number generator, drawing lots, etc. It is also possible that non-random, skill-type means, e.g. throwing a ball or dart against a target, can be used to accomplish his selection. However, in the preferred embodiment, a deck of cards is used as the means of selecting the one outcome from the plurality of possible outcomes. Thus, in the preferred embodiment, the cards simulate the various golf swings throughout a round of golf.

In a preferred embodiment the game also includes a board which is an overhead view of an existing or simulated golf course for additional entertainment value and for additional ease of recording the positions of the current players. The overhead view of the hole has identifications on it of the areas which correspond to the shots, i.e., the subsets of the master set.

A typical hole of golf is played in the game by having a first player select, by use of the selecting means, one of the plurality of outcomes in the master set in the tee shot subset (and, if applicable in the appropriate par 3, par 4 or par 5 sub-subset for the tee shot). The outcome selected dictates, for that player, the next type of shot, i.e. subset, needed (e.g. whether a long shot or a short shot is necessary to get on the green, whether the tee shot has put one on the green, whether the tee shot was out of bounds, etc.). The second player and any other additional players then likewise select the outcome for their tee shots.

After all players have taken their first shot, play then proceeds with players taking their second shots. The outcome from each player's tee shot determines which subset of outcomes is used in the second shot. One of the plurality of outcomes in the appropriate subset is selected using the selecting means and the outcome from that selection determines which subset, if any, is used for the next shot. Play continues for all players. This procedure of selecting from the plurality of outcomes continues until the outcome is that the ball has been put into the cup. The total number of selections (plus any penalty strokes or a "gimmee" stroke if applicable) by that player is then used as that player's score on the hole.

The game can be played as a single hole game, as a round of nine or eighteen holes, or indeed as a full seventy-two hole tournament if desired.

MODES FOR CARRYING OUT THE INVENTION

The present game can be played by any number of players, however, it is generally most enjoyable when from 2 to 6 play the game. As noted, in the preferred embodiment the game is played with a game board to enhance the entertainment value and help keep track of where the players are on any given hole. The game board helps keep track of the positions and next shot of the players. In the most preferred embodiment, the game board is a schematic overhead view of an existing or a newly designed eighteen hole golf course so the players can see their progress throughout the course of an eighteen hole golf game. One such hole is depicted in FIG. 1.

Figure 1:
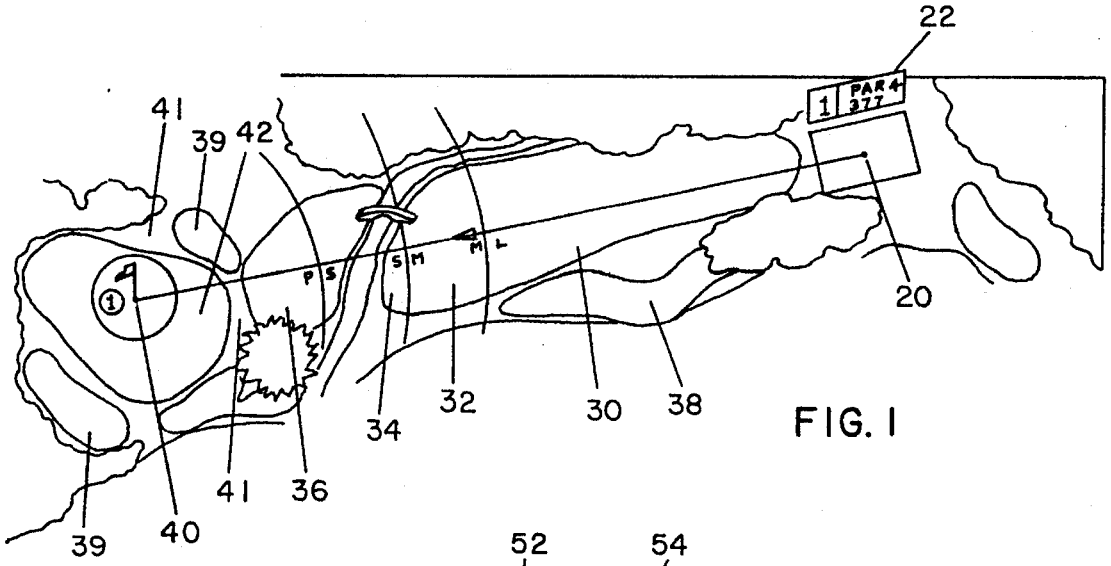
FIG. 1 is a schematic representation of a typical overhead view of a golf hole of the type to be used in the game board of the present invention.

The hole depicted in FIG. 1 is a typical hole. There are no elements on the game board design that are absolutely required for play; however, the designated areas on the hole are essential if the board is to function to position players. In the preferred embodiment, the overhead view of the hole depicts the tee 20 from which the tee shot is taken. In the area of tee 20 is located sign 22. The sign would typically display the hole number, "1" in FIG. 1, the par of the hole, "PAR 4" in FIG. 1, and the length from tee to cup, "377" yards in FIG. 1. The view usually also provides lines which divide the long iron/wood area 30 from the mid-iron area 32 from the short iron area 34 from the pitching area 36. The chipping area 41 is Just off the green 42. Putting only occurs on the green 42. Also depicted are fairway traps 38 and greenside sand traps 39. The cup 40 is also depicted. The "1" near the cup 40 is provided so as to make it clear to the player that this is the cup for hole number "1." Other features typically found on a golf course, trees, bushes, water, etc., may also be depicted. During play when using the game board, a pawn or other piece (not shown) is placed on the appropriate part of the hole depending on what shot is being taken.

The game begins by determining which player will go first. In the preferred embodiment, the player to hit first is determined by using the selection means, i.e., the cards, associated with the game.

The master set forms the central portion of the game. A typical exemplary master set is set forth in Table I.

TABLE I

EXEMPLARY MASTER SET

| | TEE SHOT | | | LONG IRON/WOOD | | | SHORT |
|---|---|---|---|---|---|---|---|
| | PAR 3 | PAR 4 | PAR 5 | PAR 4 | PAR 5 | MID-IRON | IRON |
| S | SCORE IT | PITCHING | SHORT IRON | SHORT PUTT | SHORT PUTT | GIMMEE | SCORE IT |
| A | GIMMEE | SHORT IRON | MID-IRON | LONG PUTT | LONG PUTT | SHORT PUTT | GIMMEE |
| K | SHORT PUTT | SHORT IRON | MID-IRON | LONG PUTT | CHIPPING | SHORT PUTT | GIMMEE |
| Q | SHORT PUTT | SHORT IRON | MID-IRON | LONG PUTT | SAND TRAP | SHORT PUTT | SHORT PUTT |
| J | SHORT PUTT | SHORT IRON | LONG IRON | LONG PUTT | SAND TRAP | LONG PUTT | SHORT PUTT |
| 10 | LONG PUTT | MID-IRON | LONG IRON | CHIPPING | PITCHING | CHIPPING | LONG PUTT |
| 9 | LONG PUTT | MID-IRON | LONG IRON | CHIPPING | PITCHING | CHIPPING | LONG PUTT |
| 8 | CHIPPING | MID-IRON | LONG IRON | SAND TRAP | SHORT IRON | SAND TRAP | CHIPPING |
| 7 | SAND TRAP | LONG IRON | LONG IRON | SAND TRAP | SHORT IRON | SAND TRAP | CHIPPING |
| 6 | SAND TRAP | LONG IRON | FAIRWAY TRAP | PITCHING | SHORT IRON | SAND TRAP | SAND TRAP |
| 5 | PITCHING | FAIRWAY TRAP | FAIRWAY TRAP | PITCHING | SHORT IRON | SAND TRAP | SAND TRAP |
| 4 | MID-IRON | PENALTY + MID-IRON | PENALTY + LONG IRON | SHORT IRON | MID-IRON | SHORT IRON | PITCHING |
| 3 | PENALTY + SHORT IRON | PENALTY + LONG IRON | HIT AGAIN | MID-IRON | LONG IRON | PENALTY + SHORT IRON | PITCHING |
| 2 | PENALTY + MID-IRON | OUT OF BOUNDS; TRY AGAIN | OUT OF BOUNDS; TRY AGAIN | OUT OF BOUNDS; TRY AGAIN | OUT OF BOUNDS; TRY AGAIN | OUT OF BOUNDS; TRY AGAIN | SHORT IRON |

| | | | SAND TRAP | | | PUTTING | |
|---|---|---|---|---|---|---|---|
| | PITCH | CHIP | FAIRWAY PAR 4 | FAIRWAY PAR 5 | GREEN-SIDE | LONG | SHORT |
| S | SCORE IT | SCORE IT | SHORT PUTT | LONG PUTT | SCORE IT | SCORE IT | SCORE IT |
| A | GIMMEE | SCORE IT | LONG PUTT | CHIPPING | SCORE IT | SCORE IT | SCORE IT |
| K | GIMMEE | GIMMEE | CHIPPING | IN TRAP | GIMMEE | SCORE IT | SCORE IT |
| Q | SHORT PUTT | GIMMEE | SAND TRAP | PITCHING | GIMMEE | GIMMEE | SCORE IT |
| J | SHORT PUTT | SHORT PUTT | PITCHING | SHORT IRON | GIMMEE | GIMMEE | SCORE IT |
| 10 | LONG PUTT | SHORT PUTT | PITCHING | SHORT IRON | SHORT PUTT | GIMMEE | SCORE IT |
| 9 | LONG PUTT | SHORT PUTT | SHORT IRON | MID-IRON | SHORT PUTT | SHORT PUTT | SCORE IT |
| 8 | LONG PUTT | SHORT PUTT | SHORT IRON | MID-IRON | LONG PUTT | SHORT PUTT | SCORE IT |
| 7 | LONG PUTT | SHORT PUTT | MID-IRON | LONG IRON | LONG PUTT | SHORT PUTT | GIMMEE |
| 6 | CHIPPING | LONG PUTT | MID-IRON | LONG IRON | LONG PUTT | SHORT PUTT | GIMMEE |
| 5 | CHIPPING | LONG PUTT | LONG IRON | LONG IRON | LONG PUTT | SHORT PUTT | SHORT PUTT |
| 4 | SAND TRAP | LONG PUTT | LONG IRON | HIT AGAIN | LONG PUTT | LONG PUTT | SHORT PUTT |
| 3 | SAND TRAP | CHIPPING | HIT AGAIN | HIT AGAIN | HIT AGAIN | LONG PUTT | SHORT PUTT |
| 2 | PITCHING | SAND TRAP | HIT AGAIN | HIT AGAIN | HIT AGAIN | SAND TRAP | LONG PUTT |

Turning to Table I, an exemplary master set of outcomes is listed. The first column of Table I is a listing of the card-type associated with the outcomes listed in that row. The card-type refers to the cards used in the preferred embodiment as described in more detail below. The example of Table I has the subsets and sub-subsets noted above as being a preferred embodiment. Thus there are fourteen subsets or sub-subsets set forth in the fourteen columns. Each subset has fourteen rows for the plurality of outcomes. This does not necessarily mean that each subset has fourteen different outcomes as there may be intentional duplication of various outcomes. For example, looking at the "mid-iron" subset, there are eight different possible outcomes: one "gimmee" three short putts, one long putt, two chipping, four sand trap, one short iron, one penalty and short iron, and one out-of-bounds try again. Thus, if a player was playing the game with this exemplary master set, the selection means would be determine which of the eight different possible outcomes resulted. The player would then act on that outcome. The presence of three short putt outcomes obviously makes that outcome three times as likely to be randomly selected as, for example, the long putt outcome which is only present once.

In the preferred embodiment of the invention, cards are used as the outcome selection means. Further, it is preferred that the cards themselves contain one of the plurality of outcomes for each subset. Thus, the cards are self-supporting in the sense that a separate sheet containing the master set need not be consulted. The cards themselves contain all the necessary information.

The cards in the preferred embodiment are similar to an ordinary deck of playing cards in that they have cards from deuce through an ace, however, it is preferred to add an additional card referred to in the preferred embodiment as a super ace (the equivalent of a joker). As with other decks of cards the outcomes on the cards are better with increasing number with the super ace having even better results then the ace card.

The exemplary master set in Table I thus shows the value of the cards in the preferred embodiment, from super ace to ace, king, queen, jack, ten, nine, etc. to deuce. The cards contain the outcomes listed in the row corresponding to the card value. The deck may have equal numbers of each of the cards or, as described in more detail below, may have unequal numbers of the various cards to properly regulate the occurrence of the various outcomes.

Additional specialty cards are also provided in some embodiments of the game. These additional cards can be one or more of the following: (1) a Mulligan card to replay any shot desired, (2) a Beman card which can be used to offset of penalty card, and (3) various penalty cards resulting in the penalty of one or more strokes. Other specialty cards having to do with golf activity could also be provided.

It is to be understood that the above description of the cards constitutes a description of the preferred embodiment and all that is necessary on the card is that the card provide information to determine the one outcome out of the plurality of outcomes for the particular shot being taken with or without resort to a separate master set document.

Figure 2:
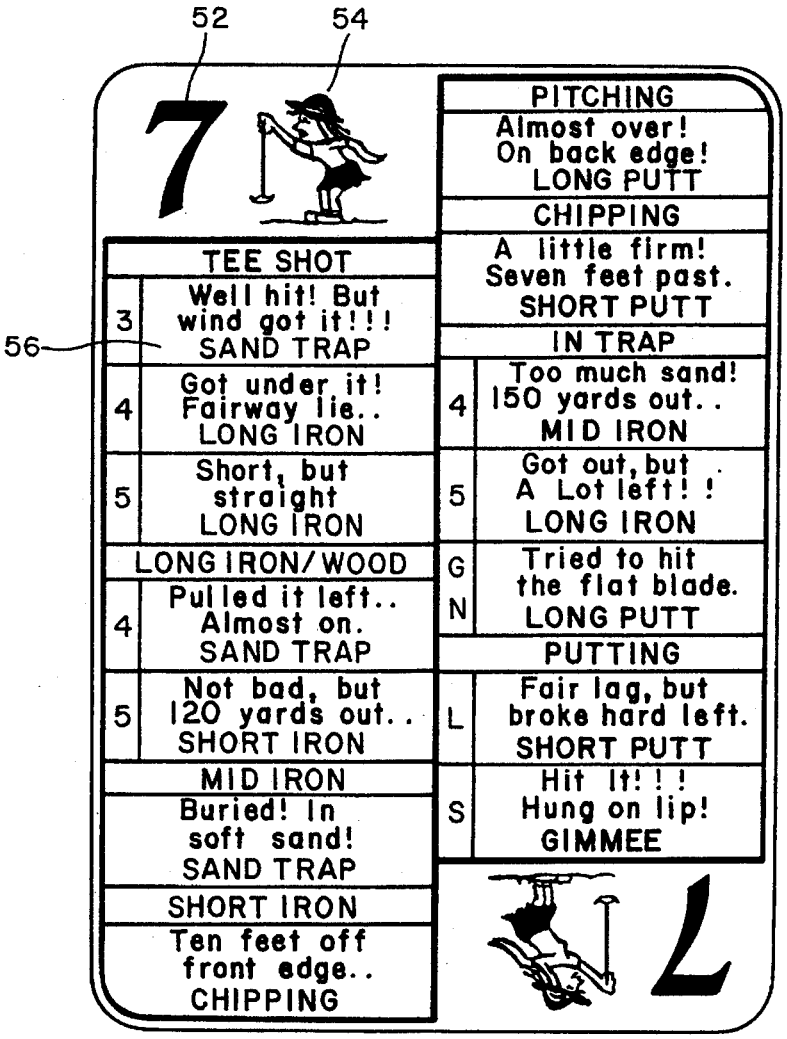
FIGS. 2 is a representation of the type of card which is used in playing the preferred embodiment of the present invention.

An example of a card of the preferred embodiment is shown in FIG. 2. The card 50 is depicted. The particular card depicted is a "seven" and has the outcomes listed that correspond to the outcomes for a seven in the exemplary master set, Table 1. The card contains its number value 52, optionally a humorous or instructional graphic 54, and the outcomes 56. As can be seen, one outcome 56 is provided for each shot (i.e., subset or sub-subset). Optionally, other text can be added to enhance the entertainment value. Thus, the outcome 56 for the par 3, tee shot sub-subset includes not only the outcome itself—"SAND TRAP"—but also the additional indication "Well Hit! But wind got it!!" to add entertainment.

In this preferred embodiment, using a deck of cards configured as shown in FIG. 2, the game can be played according to various rules. In one embodiment, players each draw a card to determine who tees off first. The player drawing the highest card is the first to tee off. Play then proceeds clockwise around the table beginning with the player who drew the "honor" of teeing off first.

After selection of the player order, the deck of playing cards is shuffled and cut by the players and placed in an area where all can have access to it. In the preferred embodiment, where the board using the overhead of a golf course is used, an area of the board is generally reserved for the playing cards. The player with the honor of teeing off first then draws a card and in doing so "hits" his or her tee shot.

In a typical game the first hole is a par 4 hole. Thus, the player looks at the card drawn directing his attention to the subset tee shot portion and more specifically the par 4 tee shot sub-subset to determine the outcome of the shot. This outcome is revealed to all players and the first player's game piece is advanced accordingly on the game board. Play continues with the other players hitting tee shots until all players have advanced their tee shot.

Play then continues with players in turn selecting cards and consulting the portion of the card corresponding to the outcome of the previous card to determine further outcomes. Play continues for each player in turn until a player reaches the green at which point he or she drops out of the play rotation until all players have reached the green.

When the last player reaches the green (either in a long putt or short putt position) putting begins. The player seated to the left of the last player to reach the green begins putting first and continues to put until he or she has holed out either by obtaining an outcome that the ball is in the hole ("SCORE IT" is this outcome in the exemplary master set in Table I) or is so close to the hole that no additional cards need be drawn because the next shot is conceded to put the ball in the cup ("GIMMEE" in the exemplary master set). Putting turn then passes to the left as with all other play with each other player putting out once they have begun putting.

After each hole has been completed by all players they move to the next tee and continue play. The "honor" of going first or subsequent holes is determined as in golf; the winner of the last hole has the honor on the tee.

After playing a hole, each player scores. This is accomplished when the player places the cards he or she has drawn on that hole in fan fashion on the table so that the cards may be seen by all players. Having the cards to look at assists each player in counting strokes after holing out. For example, if a player has four cards in front of him or her after holing out, had a penalty stroke while playing the hole and was awarded a "gimmee" (for a conceded putt) for the final stroke, he or she has 4+1(penalty)+1(gimmee)=6 strokes on the hole.

When the playing group has finished the hole and moved to the next tee, all the cards played on the last hole are placed into discard piles face down waiting to be reshuffled for further play. When the deck has been exhausted, the discard pile is reshuffled, cut and again placed in a convenient portion for further play. If the deck is exhausted while a hole is in play, the active cards in front of the player are left in place and not included in the reshuffle. The active cards are discarded only after playing on the hole has been completed.

The above description pertains to a one-deck style of play. In another embodiment of the game, the cards can be divided into two groups. The first group of cards simulates an aggressive playing style and has a concentration of cards with very good results and very bad results. The second group of cards simulates conservative style of play and has fewer cards with very good results or very bad results and more cards with average results. Play proceeds as above with the sole exception that, for each shot, the player first elects which deck to choose from. Players can change this election at their discretion including within a hole. In the preferred embodiment of two deck play, one deck simulating aggressive play and a second deck simulating conservative play, the distribution of cards (referring again to the exemplary master set of Table I with the addition of the special cards listed) in each deck is as follows:

TABLE II

| | EXMEPLARY CARD DISTRIBUTION | |
|---|---|---|
| CARD | AGGRESSIVE PLAY | CONSERVATIVE PLAY |
| Mulligan | 2 | 2 |
| Penalty | 2 | 4 |
| Beman (cancels penalty) | 2 | 2 |
| Super Ace | 4 | 0 |
| A | 8 | 2 |
| K | 8 | 2 |
| Q | 6 | 4 |
| J | 6 | 4 |
| 10 | 4 | 6 |
| 9 | 2 | 8 |
| 8 | 0 | 10 |
| 7 | 0 | 10 |
| 6 | 2 | 8 |
| 5 | 4 | 4 |
| 4 | 4 | 2 |
| 3 | 4 | 2 |
| 2 | 8 | 2 |
| TOTAL: | 66 cards | 72cards |

The distribution of cards above includes the three additional cards other than the typical shot cards. The first of these is a Mulligan card which allows the player to replay any shot except on the green. The second is the Beman card which can offset a penalty. The third card is a penalty card which contains various types of penalty strokes assessed when they are drawn. These special cards do not contain a full set of outcomes as the other cards do but rather have one outcome no matter what subset the player needs to consult as noted above.

As in golf, the lowest score on a hole wins in match play and the lowest nine hole or eighteen hole total wins in medal play. Moreover, any of the competitive wagers normally made in the real game of golf can be used in the present golf card game.

The previous description was of a preferred embodiment of the game and was in reference to golf as the game. However, one of ordinary skill in the art will recognize the adaptability of this game to other different rules. Further, the game may be adaptable to sports other than golf so long as the sport is able to be simulated by dividing the action into various subsets with a plurality of outcomes for each such subset.

Having described the invention what is claimed is:

1. A method of playing a golf board game comprising steps of:

providing a board which is a schematic overhead view of a plurality of holes of a golf course dividing each hole into a plurality of shot outcome zones;

providing at least one deck of outcome cards, each card displaying a master set of outcomes which dictate the result of that golf shot and also dictate the player's club selection for the next shot, dividing each card into a plurality of subsets, each of said subsets defining a different golf shot, and having a plurality of possible outcomes for said shot:

selecting one of said cards from the deck;

providing a game playing piece for each player;

each player moving a game playing piece on said board into the zone designated by the selected card and repeating said selecting and moving steps until the outcome of that hole is complete.

2. The method of claim 1, further comprising:

dividing said at least one deck of selecting/outcome cards into two decks one of said decks representing an aggressive style and containing a relative high concentration of cards representing good results and a relatively high concentration of cards representing bad results and the other of said decks representing a conservative style containing a relatively high concentration of cards representing moderate results; wherein said randomly selecting step comprises choosing one of said two decks to select a card from, selecting a card from the chosen deck, and revealing the information on the selected card to determine the outcome.

3. The method steps set forth in claim 1 and the additional step of providing an indication on each card by which a player may know as soon as he looks at the card he (or she) has drawn whether he (or she) has hit a good or bad shot.

* * * * *